US009602907B2

(12) United States Patent
Shaffer

(10) Patent No.: US 9,602,907 B2
(45) **Date of Patent: *Mar. 21, 2017**

(54) EARBUD CHARGING CASE

(71) Applicant: Alpha Audiotronics, Inc., New York, NY (US)

(72) Inventor: Jonathan Everett Shaffer, Huntingdon Valley, PA (US)

(73) Assignee: Alpha Audiotronics, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/838,989

(22) Filed: Aug. 28, 2015

(65) Prior Publication Data

US 2015/0373448 A1 Dec. 24, 2015

Related U.S. Application Data

(63) Continuation of application No. 14/604,082, filed on Jan. 23, 2015, now Pat. No. 9,148,717, which is a continuation-in-part of application No. 14/306,736, filed on Jun. 17, 2014, now Pat. No. 8,891,800, and a continuation-in-part of application No. 14/510,539, filed on Oct. 9, 2014, which is a continuation-in-part of application No. 14/306,736.

(60) Provisional application No. 61/942,698, filed on Feb. 21, 2014.

(51) Int. Cl.
*H04R 25/00* (2006.01)
*H04R 1/10* (2006.01)

(52) U.S. Cl.
CPC ..... *H04R 1/1025* (2013.01); *H04R 1/1016* (2013.01); *H04R 2420/07* (2013.01); *H04R 2499/11* (2013.01)

(58) Field of Classification Search
CPC ..... H04R 1/1015; H04R 1/1016; H04R 1/10; H04R 1/02; H04R 1/06; H04R 2420/07
See application file for complete search history.

(56) References Cited

U.S. PATENT DOCUMENTS

| | | | | |
|---|---|---|---|---|
| 6,498,455 | B2 * | 12/2002 | Zink | H01M 10/46 320/107 |
| 7,555,134 | B2 | 6/2009 | Dunn et al. | |
| 7,889,498 | B2 | 2/2011 | Diebel et al. | |
| 8,485,404 | B2 | 7/2013 | Monaco et al. | |
| 8,891,800 | B1 | 11/2014 | Shaffer | |
| 2005/0225292 | A1 | 10/2005 | Damlamian et al. | |
| 2005/0255898 | A1 | 11/2005 | Huang | |

(Continued)

FOREIGN PATENT DOCUMENTS

| | | | |
|---|---|---|---|
| KR | 20070093529 | A | 9/2007 |
| KR | 20090088533 | A | 8/2009 |
| WO | WO-2013166326 | A1 | 11/2013 |

*Primary Examiner* — Tuan D Nguyen
(74) *Attorney, Agent, or Firm* — Fox Rothschild LLP

(57) ABSTRACT

An electronic device housing includes one or more sidewalls configured to at least partially cover a face of a mobile electronic device, an aperture configured to receive an earbud, and an electrical connection such as a coil configured to engage with a power source and the earbud. When the earbud is positioned within the aperture and the power source is engaged with the electrical coil, the electrical connection will charge the earbud. An additional electrical connection may simultaneously charge the mobile electronic device.

21 Claims, 9 Drawing Sheets

(56) References Cited

U.S. PATENT DOCUMENTS

| | | | | |
|---|---|---|---|---|
| 2006/0177082 | A1 | 8/2006 | Solomito et al. | |
| 2007/0032274 | A1 | 2/2007 | Lee et al. | |
| 2008/0090622 | A1 | 4/2008 | Kim et al. | |
| 2008/0090626 | A1 | 4/2008 | Griffin et al. | |
| 2008/0125164 | A1 | 5/2008 | Singh | |
| 2008/0136369 | A1* | 6/2008 | Klemenz ..... | H04R 25/55 320/107 |
| 2009/0296968 | A1 | 12/2009 | Wu et al. | |
| 2011/0077061 | A1 | 3/2011 | Danze et al. | |
| 2013/0083456 | A1 | 4/2013 | Koenig et al. | |
| 2013/0129138 | A1 | 5/2013 | Washington, Jr. | |
| 2013/0148839 | A1 | 6/2013 | Stevinson | |
| 2013/0238829 | A1 | 9/2013 | Laycock et al. | |
| 2013/0265702 | A1 | 10/2013 | Merenda | |

* cited by examiner

EARBUD CHARGING CASE

RELATED APPLICATIONS AND CLAIM OF PRIORITY

This patent document claims priority to, and is a continuation of, U.S. patent application Ser. No. 14/604,082, filed Jan. 23, 2015 (the '082 application). The '082 application claims priority to, and is a continuation-in-part of: (i) U.S. patent application Ser. No. 14/306,736, filed Jun. 17, 2014 (now U.S. Pat. No. 8,891,800); and (ii) U.S. patent application Ser. No. 14/510,539, filed Oct. 9, 2014; each of which claim priority to (iii) U.S. Provisional Patent Application No. 61/942,698, filed Feb. 21, 2014. The disclosures of each priority document are incorporated herein by reference in full.

BACKGROUND

This patent document relates to a mobile device case that serves as an electrical charger and storage dock for rechargeable wireless audio earbuds.

Wireless audio earbuds ("earbuds") are a convenient way to eliminate tangled wires that impede a user's full range of motion. Existing charging devices for wireless earbuds require users to carry external battery packs, storage devices, or dedicated plug-in charging devices. Wireless earbuds are commonly tethered together (although they communicate wirelessly with a mobile device) in order to prevent loss, given inadequate forms of storage for untethered earbuds. Maintaining wireless earbuds can be inconvenient to a user because they require regular electrical charge.

This document describes devices that address some or all of the issues described above.

SUMMARY

In an embodiment, a case for a mobile electronic device includes a housing and one or more earbud receiving apertures. Each earbud receiving aperture includes or is otherwise associated with one or more electrical components configured to transfer an electrical charge from a power source to an earbud when the earbud is positioned within the aperture.

The case also may include one or more electrical components that provide a conductive connection from the power source to a power input port of a mobile electronic device that is in contact with the housing. The conductive connection enables a simultaneous charge of (1) the earbud or earbuds when the earbuds are placed in the one or more apertures, and (2) the mobile electronic device when placed in the housing.

The case also may be a case system that includes one or more earbuds, each of which is positioned to fit within one of the earbud receiving apertures, and each of which further comprises an induction coil or one or more other electrical components configured to receive a charge from the case.

Optionally, the power source is an induction charging unit. If so, then each of the apertures may be in conductive communication with an induction coil that, when placed within range of the induction charging unit, will transform an electromagnetic field received from the induction charging unit into electric current and transfer the current to the electrical contact of the aperture. Alternatively, the power source may be connected by a power cable. If so, then each of the apertures may be in conductive communication with an induction coil that is also connected to the power cable input so that when each induction coil is energized, it will generate an electromagnetic field that transfers energy to an associated induction coil of each earbud when placed in the aperture(s).

Alternatively, an external power source may connect to a jack or port of the case via a conductive cable. The cable may be configured to connect to the jack and to plug into a computing device and convey charge (and optionally data) between the devices.

Optionally, the case also may include a battery that is in electrically connected to the power source or electrical components that provide the conductive connection, each aperture, and the power input port of the mobile electronic device.

In some embodiments, an electronic device housing may include, or the housing may be, a detachable base portion that includes one or more sidewalls, one or more earbud retaining apertures positioned to be oriented perpendicular to a longest axis of the housing, and a plug extending from one of the sidewalls in a direction that is perpendicular to the orientation of the earbud retaining apertures and parallel to the longest axis of the housing. Alternatively, the detachable base portion may include one or more earbud retaining apertures positioned to be oriented parallel to a longest axis of the housing, and a plug extending from one of the sidewalls in a direction that is perpendicular to the orientation of the earbud retaining apertures and parallel to the longest axis of the housing.

Optionally, each earbud may include one or more sensors that detect when the earbud is within or outside of an earbud receiving aperture; and programming that causes the earbud to receive the output of the one or more sensors and use the output to: (1) activate the earbud when the earbud is removed from an earbud receiving aperture; and (2) power down the earbud when the earbud is placed within an earbud receiving aperture. The sensors may include a pressure sensor, a magnetic sensor, or other types of sensors.

In some embodiments, each earbud receiving aperture may include a magnet positioned to engage and secure the earbud when the earbud is positioned within the aperture. Alternatively or in addition, the electrical contacts in each earbud receiving aperture may include a magnet that secures the earbud to the aperture when the earbud is positioned within the aperture.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to."

The terms "mobile device" and "mobile electronic device" refer to a portable computing device that includes a processor and non-transitory, computer-readable memory. The memory may contain programming instructions in the form of a software application that, when executed by the processor, causes the device to perform one or image acquisition and processing operations according to the programming instructions. Examples of suitable devices include portable electronic devices such as smartphones, personal digital assistants, cameras, tablet devices, electronic readers, personal computers, media players, satellite navigation devices and the like.

The term "earbud" refers to a device designed to fit within the ear of a human, and which emits audio signals that the earbud receives from a mobile electronic device. Examples of earbuds include in-ear headphones, hearing aids and the like. Earbuds, which are sometimes also referred to as earphones, also may include or be components of other audio devices such as wireless headsets, in-ear monitors and the like.

The embodiments described in this document may help eliminate the inconvenience of additional charging devices, independent storage systems, wires, and tethered earbuds by: (1) using a mobile device case to provide electrical charge to wireless earbuds (regular mobile device charging is already required), eliminating the need for an additional charging device; edding a magnetic dock within a mobile device case to ensure secure storage and sealed transport of the earbuds without the need for an external dock, mitigating the risk of lost earbuds; and (3) allowing for untethered earbud storage, reducing pull and tangling commonly associated with earbuds connected to a mobile device with a wire and tethered wireless earbuds.

FIGS. 1-5 illustrate an embodiment of a mobile device case 11, which embeds a magnetic charging dock for two wireless audio earbuds in the rear of base portion 12.

Figure 1A:
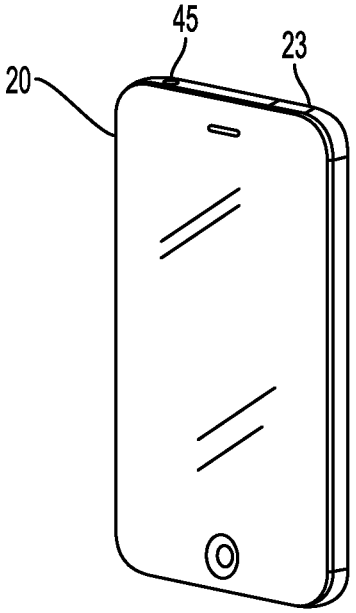
FIG. 1A is an example of a mobile device positioned within a case.
Figure 1B:
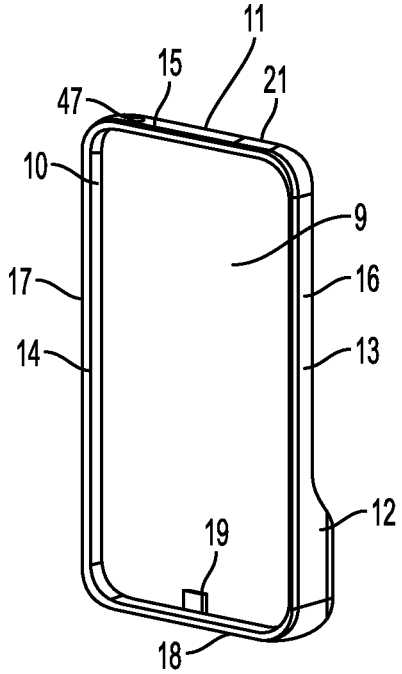
FIG. 1B is an example of a mobile device case with an earbud dock and the mobile device removed from the case.

FIG. 1A illustrates an example of a mobile device 20 positioned within a case 11. As seen in FIG. 1B, the mobile device case 11 generally comprises a base portion 12, four sidewalls 15-18, a bumper 13 that wraps around the sidewalls, and a plug 19 at the base for connecting the power port of a mobile electronic device to the case. The case 11 can be shaped to contain and protect a mobile device 20 (e.g., a smartphone). The mobile device fits snugly within the case, but a user has access to button 23, headphone jack 45, and touch screen of the mobile device either directly or through apertures embedded within the case such as 15 and 21.

Case 11 may be a single solid unit comprising four sidewalls 15-18, bumper portion 13 which runs along the exterior of the sidewalls, base portion 12 and a panel 9 that partially or fully covers a face of the mobile device, typically covering the rear face except for locations of one or more apertures that correspond to elements of the mobile device that provide audio, visual or haptic functions such as a camera, a speaker or microphone, a switch or other electrical components. The housing may include a front aperture that allows a display of the mobile device to remain open for viewing and use. Similarly, any of the sidewalls may include one or more apertures 17 positioned to expose functional elements of the mobile device, such as a microphone, speakers or power switch.

Optionally, the case 11 may be made of a material that is flexible and allows a mobile device to fit snugly within the case 11. The material may also be impact resistant to fracture when case 11 containing a mobile device 20 is dropped from a user's hand, a table, a desk and similar heights onto a variety of surfaces including concrete, asphalt, carpet, and the like. The case 11 may be made of a material that can be produced in a variety of colors. For example, the case 11 can be made of a suitable material such as polycarbonate, polypropylene, polyvinyl chloride, photopolymer, resin, metal, alloy and the like and may be made by a suitable process such as injection molding, casting or 3D printing.

Figure 1C:
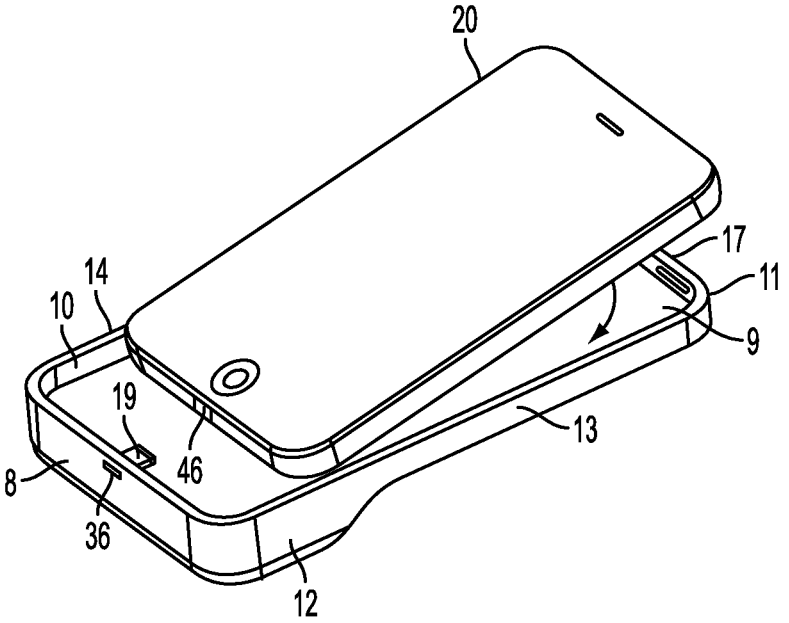
FIG. 1C shows the mobile device from FIG. 1A being inserted into the mobile device case from FIG. 1B.

As demonstrated in FIG. 1C, the user may attach the mobile device 20 to case 11 by aligning the mobile device with the base portion 12 and applying pressure to force plug 19 into the mobile device port 46. The mobile device 20 will directly contact the inner wall 10 of the case as well as back panel 9 and plug 19. At the bottom of base portion 12 of this embodiment is an aperture 34 to receive an electrical power cord.

Figure 2A:
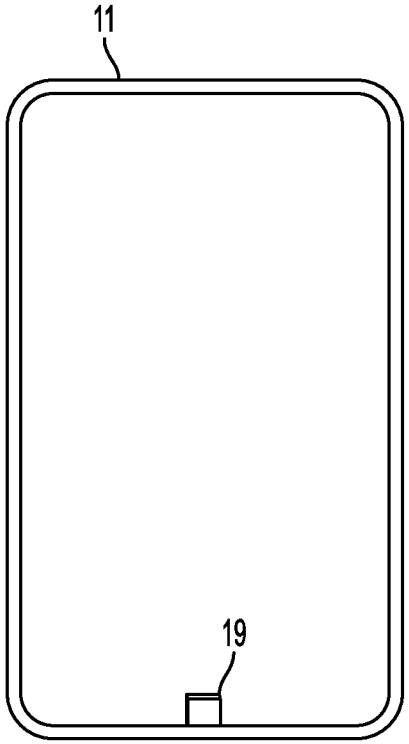
FIG. 2A is a front view of the case shown in FIG. 1B.
Figure 2B:
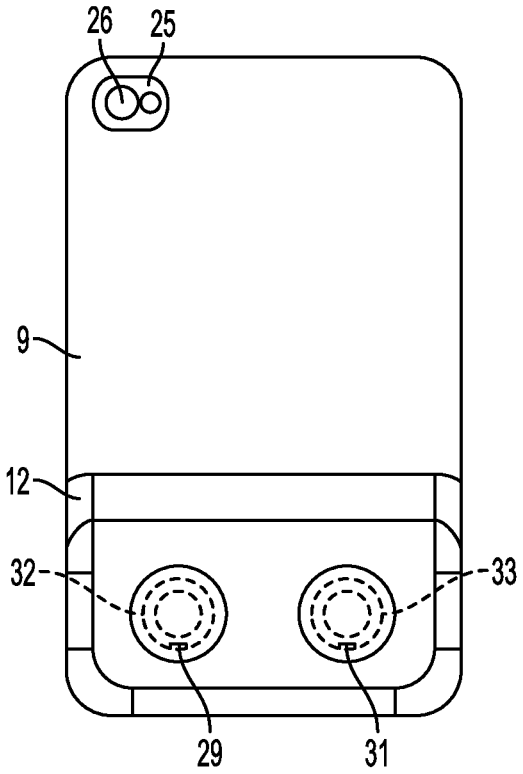
FIG. 2B is a rear view of the case shown in FIG. 1B.

FIG. 2A shows a front-facing view of case 11 containing plug 19 as seen through the aperture that corresponds to a face of a mobile device. The plug 19 may be inserted into the charging port (or "jack," which term is intended to be interchangeable with port in this document) of a mobile device and contains electrical contacts that may be configured to connect to a charging device. Electrical connectors that extend from the plug 19 will carry electric charge to both the mobile device and earbud electrical contacts 29 and 31 present on the rear of the case on the base portion 12. A first electrical connector portion from the plug will engage with a power input port or the electronic device, and a second electrical connector portion will engage with the earbud electrical contacts.

The case also may include any number of earbud receiving apertures 32 and 33. Although the example shown illustrates two apertures, the device may include a single aperture, or more than two apertures, depending on the number of earbuds that are desired to be charged. A user may insert a rechargeable earbud into each of the earbud apertures 32 and 33 to provide electrical charge via the earbud electrical contacts 29 and 31. The rear facing side of rear panel 9 may contain one or more apertures or windows 25, shaped and positioned to allow a view of and access to a feature located on the rear of the mobile device, such as a camera lens 26.

Rechargeable earbuds 34 and 35, optionally holding at least a partial charge, may be inserted into earbud apertures 32 and 33. Base portion 12 contains of a solid rear projection 22 (comprised of the lower portion 24, middle portion 22, and upper portion 16) that provides a housing for earbud apertures 32 and 33. The earbud apertures 32 and 33 may be shaped in a fashion to snugly house earbuds 34 and 35 in FIG. 3D.

Optionally, the earbud apertures 32 and 33 may have a semi hemispherical shape to allow a user to easily remove an earbud 34 and 35 from the apertures 32 and 33. In other embodiments, the earbud apertures may match at least part of the shape of the earbuds they house, which may be of any shape designed to fit at least partially within a user ear canal. The earbud apertures 32 and 33 may also contain electrical connectors/conductors, such as leads or prongs 29 and 31, allow rechargeable earbud batteries 39 and 27 to receive electrical charge via electrical earbud contacts 48 and 49 (pictured in FIG. 3D). Electrical charge will transmit from the plug to the earbud batteries 39 and 27 via an electrical connector that leads from the plug to electrical contacts 29 and 31 contained within the aperture. In certain embodiments, the aperture magnetic contact strips 41 and 42 may also serve as electrical contacts, delivering charge directly to the earbud magnetic contact strips from the plug without the need for additional prongs or leaders. The earbuds 34 and 35 possess magnetic rings 28 and 30 which allow the earbuds to connect with aperture magnetic contact strips 41 and 42 embedded within earbud apertures 32 and 33 to hold the earbuds within the earbud apertures 32 and 33.

Earbuds contain speakers, and speakers contain magnets. Therefore, in certain embodiments, the magnetic rings 28 and 30 can be omitted and the earbuds can be held within the earbud apertures 32 and 33 by the magnetic attraction between the aperture magnetic contact strips 41 and 42 and the magnet of a speaker within each earbud, respectively. In certain embodiments, the earbuds can connect to the apertures via mechanical fit such as snap-fit or screw-in, in such a manner so that when securely stored, the electrical earbud contacts 48 and 49 connect with aperture electrical contacts 29 and 31.

Figure 3A:
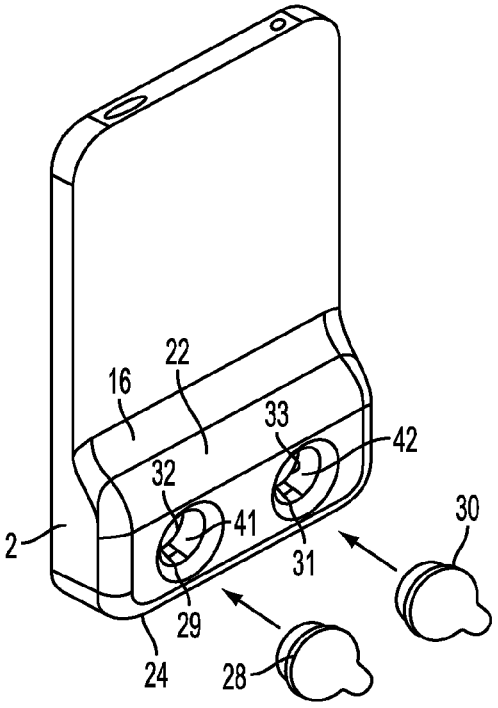
FIG. 3A is a rear view of the case from FIG. 1B with earbuds shown in FIG. 3D entering the case.
Figure 3B:
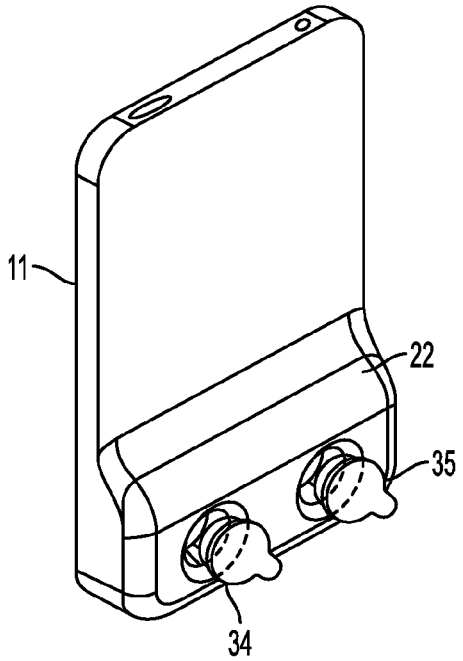
FIG. 3B is a rear view of the case from FIG. 1B with earbuds shown in FIG. 3D docked with the case.

FIG. 3B shows earbud 34 entering case 11.

Figure 3C:
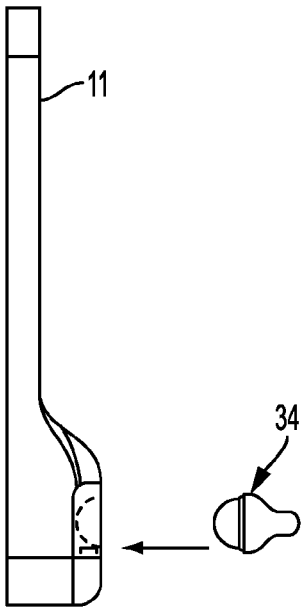
FIG. 3C is a side perspective of the case from FIG. 1B with earbuds shown in FIG. 3D entering the case.

FIG. 3C shows a side angle of earbuds 34 and 35 docked with case 11.

Figure 3D:
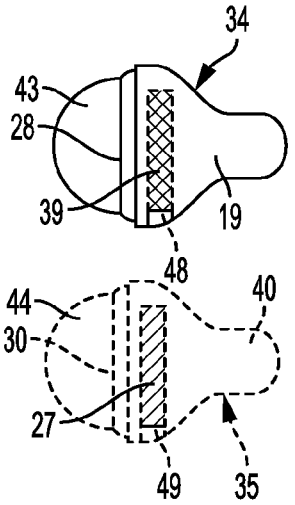
FIG. 3D is a simplified diagram of an example of a set of wireless earbuds from FIGS. 3A-3C.

FIG. 3D shows earbuds 34 and 35 that contain internal rechargeable batteries 39 and 27 and electrical contacts 48 and 49. The earbuds are outfitted with magnetic rings 41 and 42 that allow a connection with magnetized earbud aperture rings 28 and 30 to ensure the earbuds remain securely retained within apertures 32 and 33. Wireless earbuds typically include internal components, such as acoustic and transmitter/receiver (e.g. Bluetooth®, or near field communication capabilities) that communicates wirelessly with a mobile device such as 20. The earbud tips 43 and 44 that contact the user's ear canal may be made from a soft material such as silicone, rubber, resin, photopolymer and the like produced by injection molding or anatomically customized for a user ear canal via 3D printing. The earbud grips 40 and 19 do not contact the user's ear but provide a means for users to grasp and remove them from and ear and may be made of any plastic such as polycarbonate, polypropylene, polyvinyl chloride, photopolymer, resin, metal, alloy and the like and available in a variety of hues. In some embodiments, case 11 can be outfitted to store and charge in-ear hearing aids via apertures 32 and 33.

Electrical components contained within case 11 may comprise such components as wires, printed circuit boards, capacitors, resistors, and the like. The electrical components may transfer the charge from the charging device, to the earbud aperture electrical contacts 29 and 31 and to a mobile device 20 connected to the plug 19. The electrical components may also allow the earbud batteries 39 and 27 to be charged when the earbuds 34, 35 are placed in the earbud apertures 32 and 33 in the case 11 when a charging cable 1000 is inserted into the inlet 36 (see FIG. 5A) and connected to a power source such as a computer or a power outlet.

Figure 4:
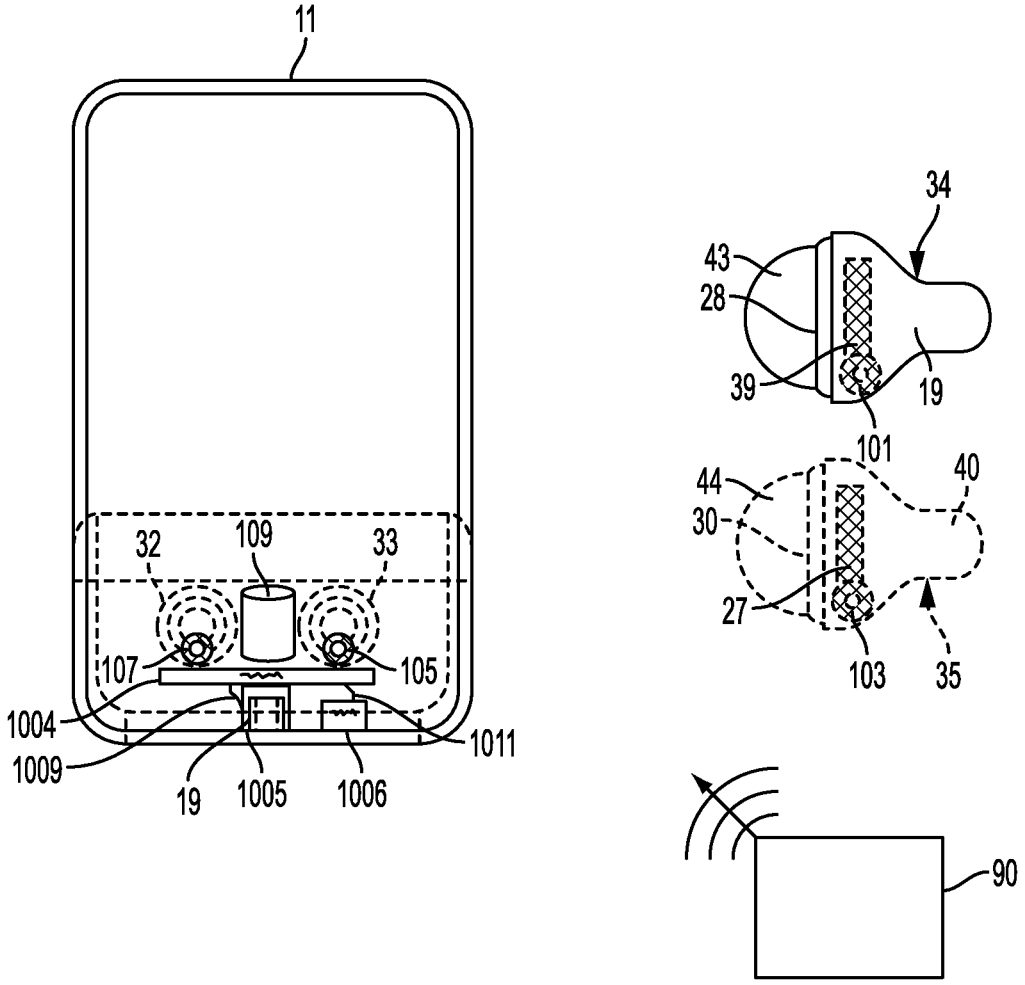
FIG. 4 is a block diagram of various electronic components within a mobile device case.

FIG. 4 shows a view of the case 11 illustrating an example embodiment of its internal electrical components. As shown in the figure, there may be three (or any number of) printed circuit boards (or "PCBs"), the main PCB1 1004, PCB2 1005, and PCB3 1006. PCB1 1004 is the main PCB in the example shown, and it may contain such items as a controller, firmware, an authentication chip, and a battery charging circuit. PCB2 1005 may contain a case connector, such as a 30-pin connector, Lightning connector or other connector. PCB3 1006 may contain the USB connector. Main PCB1 1004 connects to PCB2 1005 through a conductive element portion 1009 such as a cable, trace or bus. Main PCB1 1004 also connects to PCB3 1006 through a conductive element portion 1011. Main PCB1 is electrically connected to plug 1 and may transfer electrical charge to and from the rechargeable earbud batteries 39 and 27 via earbud electrical contacts 48 and 49, as well as the mobile device 20.

Figure 5A:
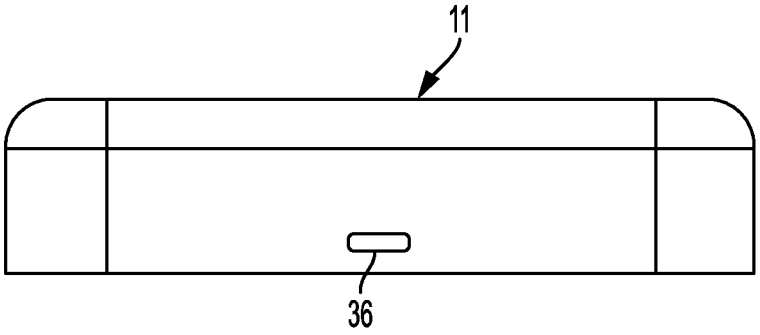
FIG. 5A is a bottom perspective of the case from FIG. 1B.
Figure 5B:
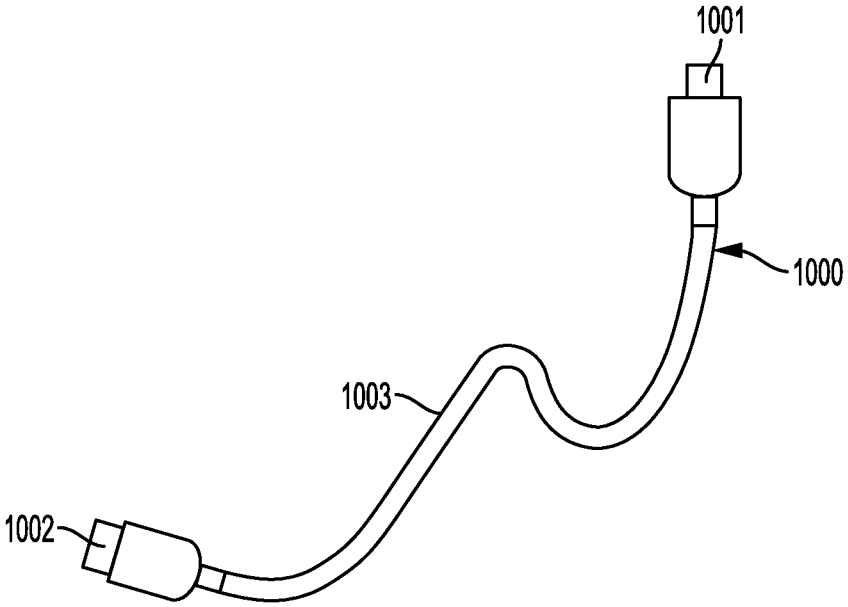
FIG. 5B illustrates a charging or data cable that connects with the case from FIG. 1B.

FIG. 5A illustrates embodiment in which an inlet jack 36 that may serve as a port to the plug 19 of FIG. 4. The inlet jack 36 may include a multi-pin or other connector that corresponds to a connector of charging device (such as cable 1003 in FIG. 5B) that may be used to charge earbud batteries 39 and 27 when it is placed in the earbud apertures 32 and 33. The charging cable 1000 may be configured to plug into a power source, such as a computer, laptop device, car outlet, or a power outlet and the like.

A data or charging device may comprise any device that may transfer power from a power source to the case 11. In some embodiments, the charging device may be a charging and/or data cable such as charging cable 1000.

The charging and/or data cable 1000 may have a male connector 1001, at one end configured to be inserted into the case 11, another male connector 1002 at the other end shaped to connect to a power source, and a wire 1003 joining the connectors 1001, 1002. The charging and/or data cable 1000 may be capable of transferring power and/or data between a power source and/or computer and a case. Thus, the charging cable may also be a data cable that is configured to connect to the jack and to plug into a computing device and convey charge and data to the case from the computing device.

The charging cable 1000 may be any type of cable having any number of wires that can electronically connect the case 11 to a computer or power source. In one embodiment, the cable is a USB cable where male connector 1001 is a USB mini-A plug and male connector 1002 is a USB type-B plug. The charging cable 1000 may allow rechargeable earbud batteries 39 and 27 to be charged by a computer and/or power source.

Alternatively, or in addition to the input jack and cord, referring back to FIG. 4, earbuds 34 and 35 may receive power from earbud apertures 32 and 33 via an induction charging unit.

The case itself can serve as the source of induction charge for earbuds 34 and 35 by applying the current from the power input jack to aperture coils 107 and 105, which will create an electromagnetic field to inductively charge earbud batteries 39 and 27. Each aperture coil may be associated with an aperture by being electrically connected to the aperture, or simply by being positioned proximal to the aperture so that an electromagnetic field generated by the aperture coil will extend to its associated aperture. Thus, the coils of the case may inductively couple with the coils of the earbuds so that energy transfers from the case coils to the earbud coils. Or, alternatively an external induction charging unit 90 such as a charging tray, mat or other device can electrify aperture coils 107 and 105 when case 11 is in the presence of the charging unit 90. Or in a third variation, the external induction charging unit can transfer charge directly to earbud coils 101 and 103, when the earbuds 34 and 35 are placed in the tray, or within the range of an electromagnetic field generated by the tray when the tray is connected to a power source, within or without case 11.

In this configuration, when the case is placed within the range of an electromagnetic field of an induction charging unit, an electrical coil 105 and 107 embedded within each of the apertures 32 and 33 will create an electromagnetic field that the earbuds 34 and 35 will enter when placed in the earbud apertures. Additional induction coils 101 and 103 embedded within each of the earbuds 34 and 35 transform the electromagnetic field created by aperture coils 105 and 107 into electric current. The earbud induction coils 101 and 103 direct the electric current to earbud rechargeable batteries 39 and 27, thus delivering at least partial charge to earbuds 34 and 35.

In some embodiments, case 11 may contain an internal rechargeable battery 109. The electrical components within case 11 may transfer the charge from a power source via plug 19, or from the induction coils 105, 107, to the earbud aperture electrical contacts 29 and 31 through PCB3 1006 and PCB1 1004. PCB1 1004 also may route electrical charge to case rechargeable battery 109 in a parallel or series connection with earbud aperture electrical contacts 29 and 31. For example, PCB1 1004 may include, or the system may otherwise include, a bus or other conductor that electrically connects the battery 109, each electrical contact 29 and 31, and the plug 19 and/or induction coils 105, 107.

The case rechargeable battery 109 also may be electrically connected to PCB1 1004, which can route electric charge from battery 109 to electrical contacts 29 and 31 when case 11 is not engaged with a power source and earbud batteries 34 and 35 are not fully charged. Thus either a charging source such as 1000 in FIG. 5B or rechargeable case battery 109 can supply charge to case 11 electrical earbud contacts 29 and 31 in order to charge rechargeable batteries 39 and 27. Main PCB1 1004 may contain any firmware or other software needed to appropriately balance the charge directed to rechargeable batteries 39 and 27 and case rechargeable battery 109, and the charge exchanged between all three rechargeable batteries and a mobile device connected to case 11.

Optionally, in any of the embodiments discussed above, a switch may be positioned between the case's power input and the earbud, electronic device, and/or other components such as a case battery. For example, a transfer switch may be positioned between the power input and the two (or more) loads so that a user may select which component will receive the charge by selecting different positions of the transfer switch. Alternatively, an electrically operated switch, such as a static transfer switch or relay, may alternate positions (and thus direct charge to the various components) either in response to one or more commands, or at periodic intervals. For example, the switch may be in communication with a clock that causes the switch to alternate positions at various intervals. Or the switch may be a component like a silicon-controlled rectifier that is responsive to a sensed voltage, and which switches from a first component to a second component when it senses that the voltage across the first component has achieved a threshold. Optionally, the switch also may include a neutral setting in which it connects to none of the chargeable components, thus saving or reducing power draw when all components are fully charged or charged to at least a threshold level.

Figure 6:
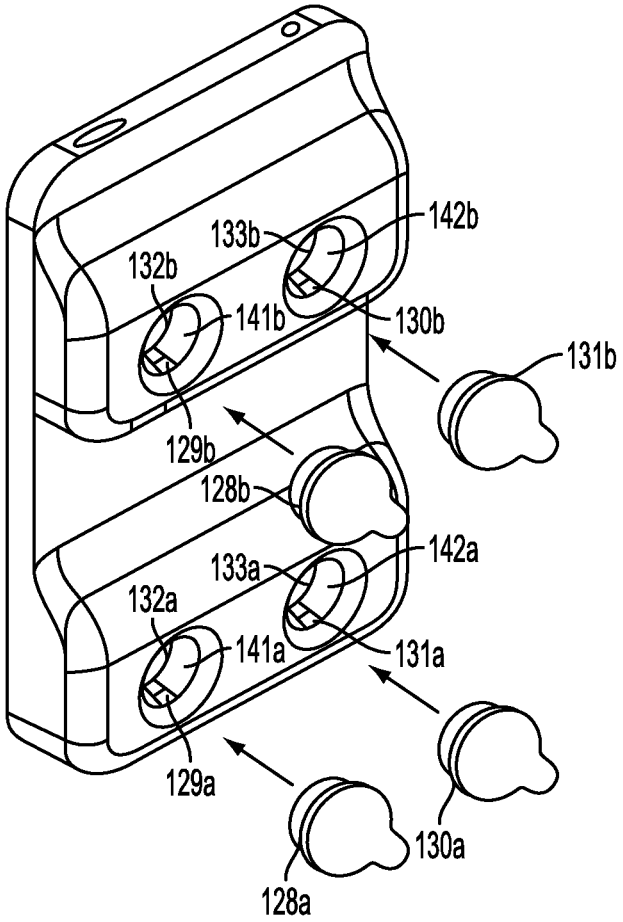
FIG. 6 is a rear view of a mobile device case according to an embodiment of the invention.

FIG. 6 is a rear view of a mobile device case according to an embodiment of the invention. As shown in FIG. 6, a mobile device case can include a plurality of earbud apertures 132*a-b* and 133*a-b*. The earbud apertures can include electrical contacts 129*a-b* and 131*a-b* and magnetic retention rings 141*a-b* and 142*a-b*, respectively. Each earbud can include magnetic rings 128*a-b* and 130*a-b*. The magnetic retention rings 141*a-b* and 142*a-b* can retain the earbuds in the earbud apertures 132*a-b* and 133*a-b* through the magnetic attraction between the retention rings 141*a-b* and 142*a-b* and the earbud magnetic rings 128*a-b* and 130*a-b*, respectively. Although ring-shaped magnets have been shown and described, those of skill in the art will appreciate that other shapes and configurations of magnets (e.g. disk, bar) can generate sufficient magnetic attraction to securely retain the earbuds in their respective apertures.

Figure 7:
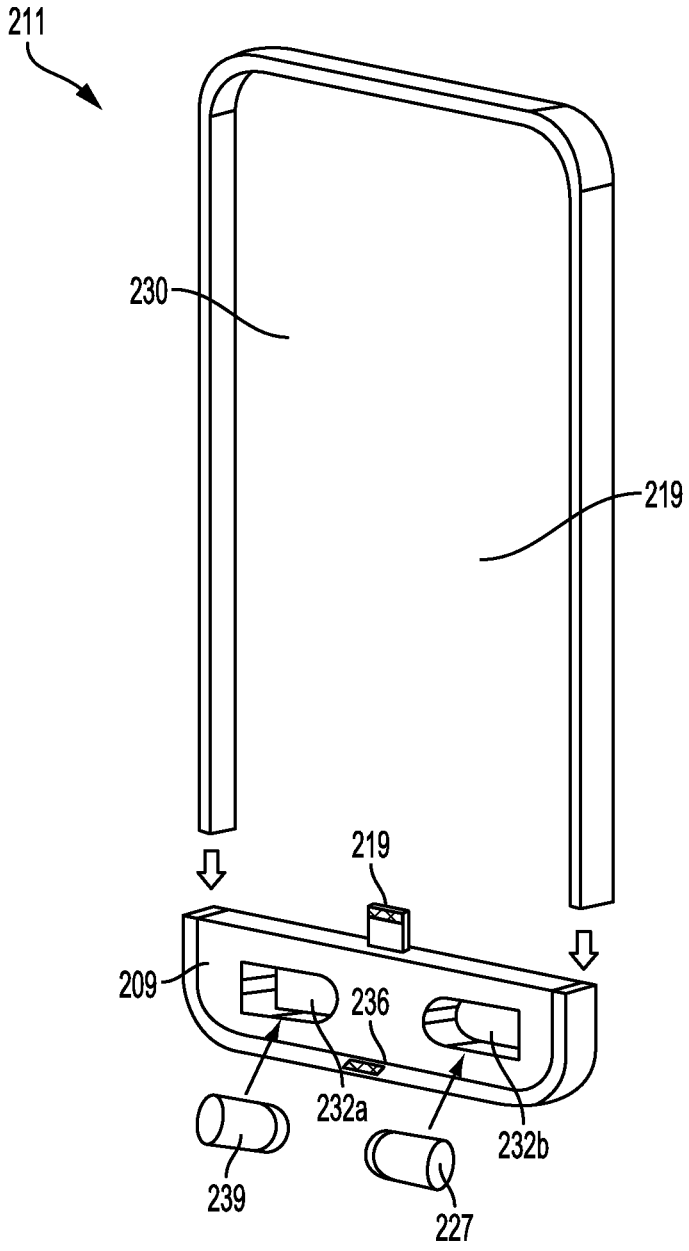
FIG. 7 illustrates an alternate embodiment of a mobile device case/earbud charger.

FIG. 7 illustrates an alternate embodiment of a mobile device case 211 in which the rear panel is a base portion 209 containing apertures for the earbuds. In this embodiment, the base portion 209 may be positioned over only a portion of the mobile device, or over none of the mobile device, so the rear of the mobile device is partially or fully open. This embodiment may have electronics similar to those shown in FIG. 4, although here the electronics may be positioned underneath the mobile device instead of behind it. The base portion 209 contains earbud apertures 232*a-b* that are configured to receive earbud batteries 239, 227 as in previous embodiments. Note that in this embodiment, the "rear" panel may alternatively be positioned so that the earbud apertures 232*a-b* are positioned to correspond to either the front or the rear of the mobile device (or on the top or bottom of the mobile device). One of skill in the art will recognize that the embodiment of FIG. 7 may contain apertures for a single earbud or any number of earbuds. In this embodiment, or even in embodiments where a rear panel exists, the base portion 209 may serve as a bumper that is positioned adjacent the lower sidewall of the case and removably detachable from the case via one or more connectors. In an embodiment, the base portion 209 itself may contain an inlet for receiving power 236 and the plug 219 that extends through the case to be received by a charging port of a mobile electronic device.

Figure 8:
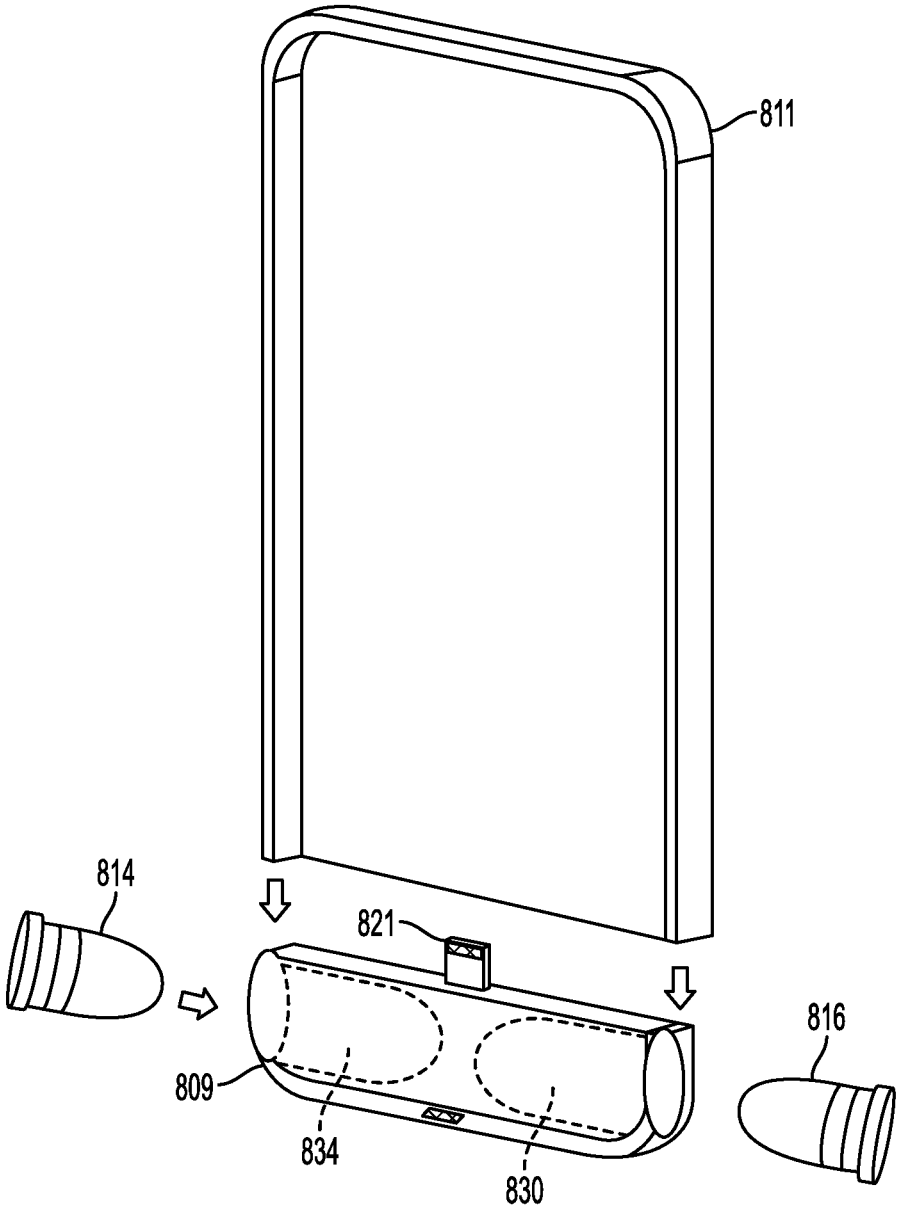
FIG. 8 illustrates a variation of the embodiment of FIG. 7.

FIG. 8 illustrates an alternative configuration of the embodiment of FIG. 7, where in FIG. 8 the detachable base portion 809 of case 811 has both earbud retaining apertures 830 and 834 are oriented horizontally (i.e., perpendicular to the longest axis of the case) and positioned at opposing sides of the base portion 809. In this embodiment, earbuds 814 and 816 enter the base portion 809 of case 811 from the sides to be contained within the sidewalls (i.e., housing) of the base portion 809. Thus, the base portion 809 serves as a housing for the earbuds, and the base portion may be attached to and part of, or separated from, the overall case 811. A plug 821 such as a USB connector, lightning connector or other multi-pin connector that is configured to be connected to a mobile electronic device and capable of transferring power and/or data extends from one of the sidewalls in a direction that is perpendicular to the orientation of the earbud retaining apertures and parallel to the longest axis of the housing of the case 811. FIG. 8 also shows an alternative configuration of earbuds 814 and 816 which reflect the shape of the earbud apertures 834 and 830, although one of skilled art can appreciate that the earbud retaining apertures may take any shape that securely fits the earbuds when the earbuds are inserted to the apertures.

Figure 9:
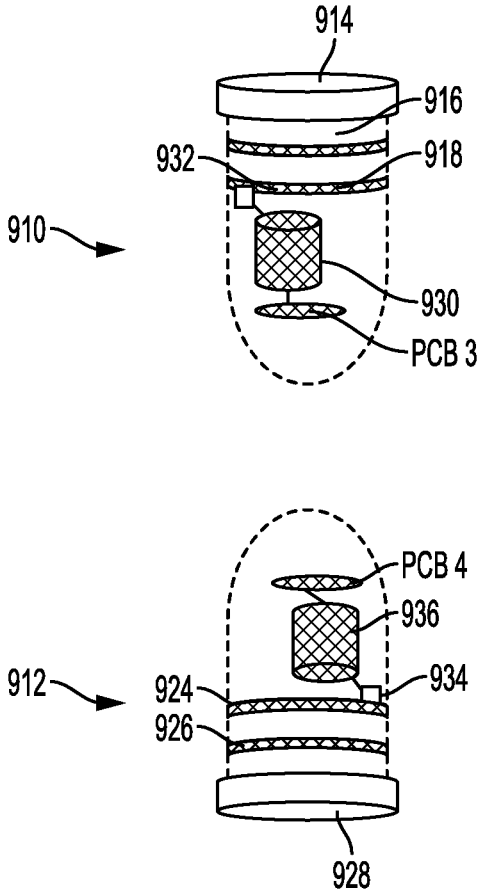
FIG. 9 illustrates various features of an embodiment of a set of earbuds.

FIG. 9 illustrates an embodiment in which the earbuds are equipped with features that enable them to automatically trigger on and off. In this embodiment, earbuds 910 and 912 include earbud rechargeable batteries 930 and 936 and earbud electrical contacts 932 and 924. The earbuds are outfitted with magnetic rings 916 and 926 that allow a connection with magnetized earbud aperture rings to ensure the earbuds remain securely retained within earbud apertures (e.g., 834 and 830 of FIG. 8) which may also contain magnetic elements. Wireless earbuds typically include internal components, such as a transmitter/receiver (e.g. Bluetooth®, or near field communication equipped) that communicates wirelessly with a mobile smart phone or other device.

These components may be connected to printed circuit boards PCB 3 and PCB 4 within the earbuds and may contain encoded firmware or other programming instructions to automatically trigger on when the earbuds are removed from the earbud apertures, and turn off upon return to the apertures. The system may detect these positional changes by any suitable means. For example, Each earbud may include one or more contact sensors, such as pressure sensors or magnetic sensors that detect when the earbud is in (or out of) the aperture and which send a corresponding signal to the earbud PCBs. Firmware embedded within the earbud PCBs could cause a circuit that includes the rechargeable earbud batteries 930 and 936 to switch on or off, or return them to a low-energy consumption idle mode.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. An electronic device housing, comprising:

one or more sidewalls configured to partially or fully cover a face of a mobile electronic device; an aperture configured to receive an earbud; a first electrical connection configured to engage a power source with a power input port of the mobile electronic device; and a charging circuit configured to engage the power source with the earbud; so that when the earbud is positioned within the aperture and the power source is engaged simultaneously with the first electrical connection and the charging circuit, simultaneous charge of the earbud and the mobile electronic device is enabled.

2. The housing of claim 1, further comprising a magnet positioned to magnetically retain the earbud in the aperture.

3. The housing of claim 2, further comprising:

an additional aperture configured to receive an additional earbud; and an additional electrical connection configured to engage the power source with the additional earbud;

wherein the additional aperture comprises an additional magnet positioned to magnetically retain the additional earbud in the additional aperture; and wherein when the additional earbud is positioned within the additional aperture and the power source is also engaged with the additional electrical connection, the simultaneous charge of the first earbud and the mobile electronic device also includes a charge of the additional earbud.

4. The housing of claim 1, further comprising a port configured to receive a power input cable from the power source.

5. The housing of claim 4, further comprising a charging device that comprises a cable that is configured to connect to the port and to plug into a computing device and convey charge and data to the housing from the computing device.

6. The housing of claim 1, wherein the housing comprises a base portion for an electronic device case, and the base portion also comprises a plug configured to be connected to a mobile electronic device.

7. The housing of claim 6, wherein the plug is oriented in a direction that is perpendicular to an orientation of the aperture.

8. The housing of claim 1, wherein:

the power source comprises a plug configured to receive a charging cord;

the charging circuit comprises an induction coil; and the induction coil is positioned so that when the earbud is positioned within the aperture and the induction coil is energized, energy will transfer from the induction coil to the earbud.

9. The housing of claim 1, wherein:

the power source comprises an induction charging unit; and the aperture is in conductive communication with an induction coil that, when placed within range of the induction charging unit, will transform an electromagnetic field received from the induction charging unit into electric current and transfer the current to the charging circuit.

10. The housing of claim 9, wherein the induction charging unit is external to the housing.

11. The housing of claim 1, wherein:

the power source comprises a battery that is a component of the housing;

the charging circuit comprises an induction coil; and the induction coil is configured to transform current received from the battery into an electromagnetic field that will charge the earbud.

12. The housing of claim 1, wherein:

the power source comprises a battery that is a component of the housing; and the housing also comprises an induction coil that is configured to transform an electromagnetic field received from an external induction charging unit into electric current and transfer the current to the battery.

13. The housing of claim 1, wherein:

the housing also comprises the earbud;

the power source comprises an induction charging unit that is external to the housing; and the earbud comprises a coil that is configured to receive an electromagnetic field from the induction charging unit.

14. The housing of claim 1:

further comprising a magnet positioned to magnetically retain the earbud in the aperture;

wherein the charging circuit comprises an induction coil; and wherein the power source comprises an induction charging unit.

15. An electronic device housing, comprising:

one or more sidewalls configured to at least partially cover a face of a mobile electronic device; an aperture configured to receive an earbud; a charging circuit having an electrical coil configured to engage with a power source and the earbud, so that when the earbud is positioned within the aperture and the power source is engaged with the charging circuit, the charging circuit will charge the earbud; and an electrical contact configured to engage the power source with the mobile electronic device, so that when mobile electronic device is within the housing and the power source is engaged simultaneously with the charging circuit and the electrical contact, the mobile device and the earbud will be simultaneously charged.

16. The housing of claim 15, further comprising a magnet positioned to magnetically retain the earbud in the aperture.

17. The housing of claim 15, wherein:

the power source comprises an external induction charging unit; and when the housing is placed within range of the external induction charging unit, the electrical coil will transform an electromagnetic field received from the external induction charging unit into electric current and transfer the current to the earbud.

18. The housing of claim 15, wherein:

the power source comprises a battery that is a component of the housing; and the charging circuit is configured to transform current received from the battery into an electromagnetic field that will charge the earbud.

19. The housing of claim 15, wherein:

the power source comprises a battery that is a component of the housing; and the housing also comprises an induction coil that is configured to transform an electromagnetic field received from an external induction charging unit into electric current and transfer the current to the battery.

20. The housing of claim 15, wherein the power source comprises a battery that is a component of the housing.

21. The housing of claim 15:

further comprising a magnet positioned to magnetically retain the earbud in the aperture; and wherein the power source comprises an induction charging unit that is external to, or a component of, the housing.

* * * * *